United States Patent [19]

Yamashita et al.

[11] Patent Number: 5,011,767

[45] Date of Patent: Apr. 30, 1991

[54] SILVER HALIDE PHOTOGRAPHIC EMULSION

[75] Inventors: Seiji Yamashita; Shunji Takada, both of Minami-ashigara, Japan

[73] Assignee: Fuji Photo Film Co., Ltd., Kanagawa, Japan

[21] Appl. No.: 352,960

[22] Filed: May 17, 1989

[30] Foreign Application Priority Data

May 18, 1988 [JP] Japan ..... 63-121443

[51] Int. Cl.[5] ..... G03C 1/02

[52] U.S. Cl. ..... 430/567; 430/569; 430/570

[58] Field of Search ..... 430/567, 569, 570

[56] References Cited

U.S. PATENT DOCUMENTS

| | | | |
|---|---|---|---|
| 4,094,684 | 6/1978 | Maskasky . | |
| 4,142,900 | 3/1979 | Maskasky | 430/567 |
| 4,435,501 | 3/1984 | Maskasky | 430/434 |
| 4,463,087 | 7/1984 | Maskasky | 430/567 |
| 4,471,050 | 9/1984 | Maskasky | 430/567 |

*Primary Examiner*—Paul R. Michl
*Assistant Examiner*—Thomas R. Neville
*Attorney, Agent, or Firm*—Birch, Stewart, Kolasch & Birch

[57] ABSTRACT

The present invention relates to a silver halide photographic emulsion comprising silver halide grains dispersed in a binder, wherein grains of 30% or more of a total projected area of all silver halide grains are junctioned silver halide grains, each of the junctioned grains has substantially one junction per grain, and a crystal structure of a substrate grain of the junctioned grain is a rock-salt structure.

6 Claims, 4 Drawing Sheets

SILVER HALIDE PHOTOGRAPHIC EMULSION

BACKGROUND OF THE INVENTION

1. Field of the Invention

The present invention relates to a silver halide photographic emulsion and a photographic light-sensitive material using the same and, more particularly, to a silver halide grain having a novel form and a method of manufacturing the same.

2. Description of the Related Art

In recent years, as small formatting of a film has progressed or photographing conditions have been diversified, a strong demand has arisen for a film having high sensitivity and capable of exposure within a wide range of applications. Under the circumstances, a silver halide in an emulsion must have, as its basic performance, high sensitivity, a low fogging property and a small grain size. Improvements in such performance contribute to progress in silver halide light-sensitive materials as a whole. In order to manufacture an emulsion having high sensitivity and small grain size, it is preferred to prevent efficiency-lowering and increase quantum efficiency of a grain itself in an exposure process. Possible factors of the low quantum efficiency are recombination, latent image dispersity, a competing electron trap derived from a lattice defect, and the like. A number of conventional techniques have been proposed for a composite silver halide crystal formed by epitaxially junctioning a crystal having a halogen composition different from that of a substrate grain to a specific portion of the grain upon silver halide grain formation. For example, JP-A-53-103725 (37 JP-A-" means unexamined published Japanese patent application) discloses a method of epitaxially growing silver chloride crystals on a silver iodide crystal substrate capable of absorbing light of a long wavelength to form grains having spectral sensitivity of silver iodide and a developing property of silver chloride, thereby improving photographic sensitivity. JP-A-59-133540 discloses a method of manufacturing a grain having high sensitivity by epitaxially growing a silver salt at a portion, selected in the presence of a site director, of a host grain having an average aspect ratio of less than 8 and surrounded mainly by (111) crystal planes.

In the above junctioned grain, the location of a junction is defined to a surface, an edge, a corner or a combination thereof by the site director. Therefore, as shown in FIG. 3 of JP-A-59-133540, even if the junction is limited to a corner, a single grain has substantially six or more junctions. In addition, as shown in FIG. 5 of JP-A-59-133540, when epitaxial growth on surface is performed, junctions spread on the overall grain surfaces and therefore the number of point of junction cannot be counted.

JP-A-53-103725 discloses a method of epitaxially growing silver chloride on a substrate consisting of $\beta$-phase silver iodide crystals having a wurtzite crystal structure. JP-A-53-103725 describes that a silver chloride epitaxially grown portion is generally present one for each grain. In the case of a substrate grain consisting of silver bromide, silver chloride, silver iodobromide, silver bromochloride or silver chloroiodobromide having a rock-salt structure, however, no junctioned grain having only one junction has been reported in any published literatures including JP-A-53-103725.

JP-A-59-133540 describes that a silver salt epitaxially grown portion can function as an electron trap in a latent image formation process. If the latent dispersity is considered as a factor of the low quantum efficiency, the conventional junctioned grain having a plurality of junctions or a wide junction area per grain easily causes latent dispersity and provides only insufficient high-intensity sensitivity.

SUMMARY OF THE INVENTION

It is an object of the present invention to provide a silver halide emulsion having low latent dispersity and high high-intensity sensitivity and, more particularly, to a photographic emulsion of junctioned silver halide grains having low latent dispersity and high high-intensity sensitivity.

The object of the present invention is achieved by a silver halide photographic emulsion comprising silver halide grains dispersed in a binder, wherein grains of 30% or more of a total projected area of all silver halide grains are junctioned silver halide grains, each of the junctioned grains has substantially one junction, and a crystal structure of a substrate grain of the junctioned grain is a rock-salt structure, and a light-sensitive material using the same.

BRIEF DESCRIPTION OF THE DRAWINGS

FIG. 2A shows silver halide substrate grains, FIG. 2B shows silver halide grains of emulsion 2-A, FIG. 2C shows silver halide grains of emulsion 3-A, FIG. 2D shows silver halide grains of emulsion 3-B, and FIG. 2E shows silver halide grains of emulsion 3-C.

DETAILED DESCRIPTION OF THE INVENTION

Figure 1A:
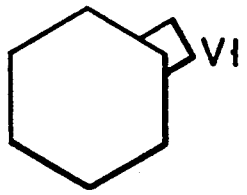
FIGS. 1A, 1B and 1C are schematic views showing a one-point junctioned grain according to the present invention, in which $V_1$ in FIGS. 1A and 1B represents an epitaxially grown portion, an $V_1$ and $V_2$, in FIG. 1C represent epitaxially grown portions wherein $V_1$ represents a main grown portion, and $V_2$ represents a small grown portion.
Figure 1B:
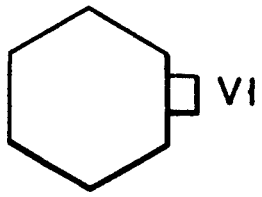
Figure 1C:
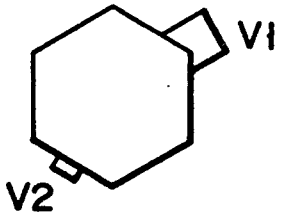
Figure 2A:
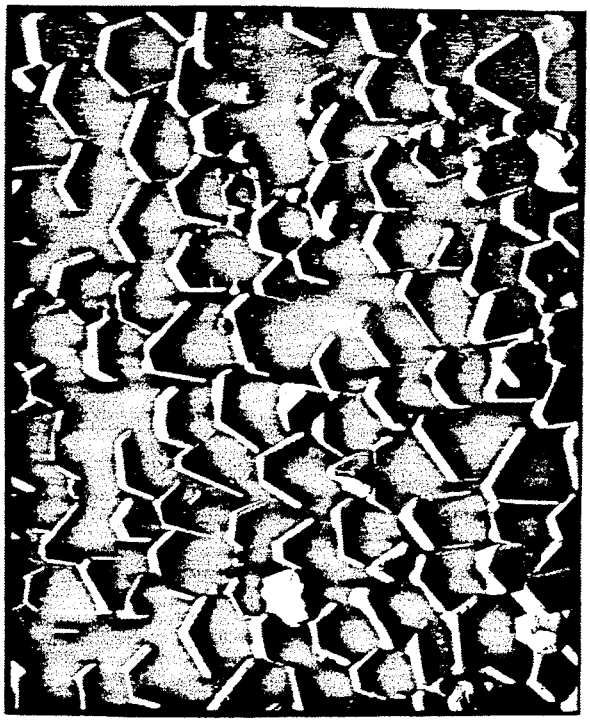
FIGS. 2A, 2B, 2C, 2D, and 2E are electron micrographs showing silver halide grains in emulsions in Example 1 (magnification=3,000). Specifically.
Figure 2B:
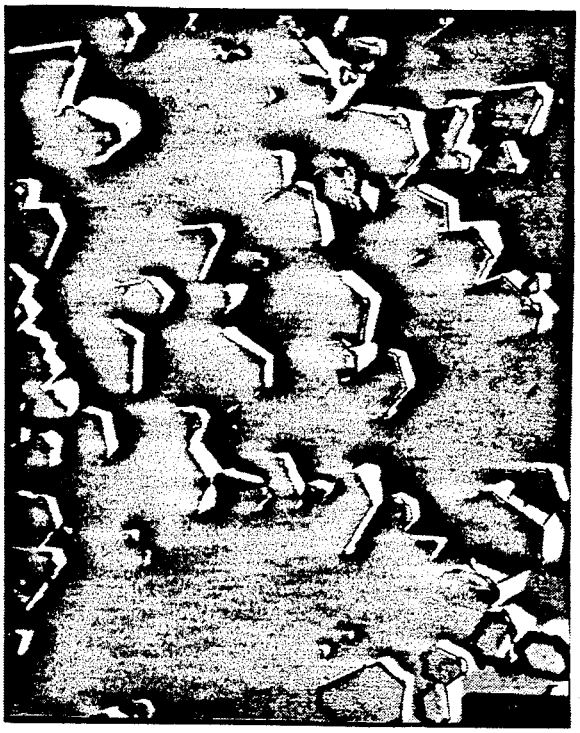
Figure 2C:
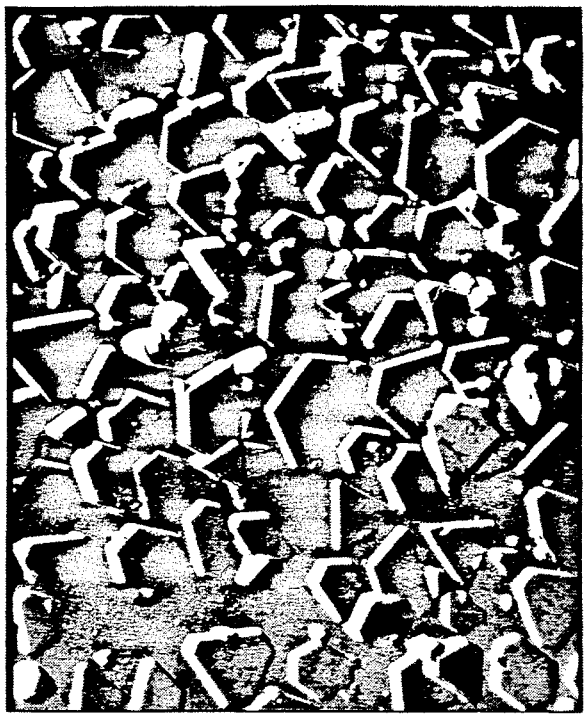
Figure 2D:
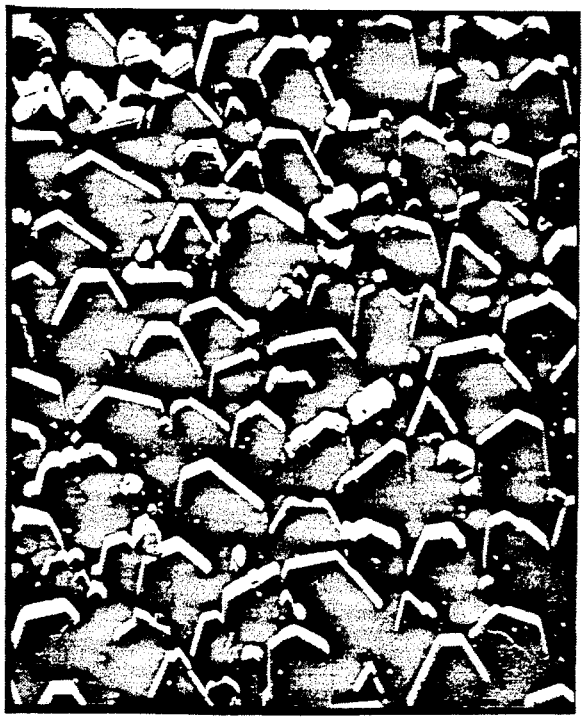
Figure 2E:
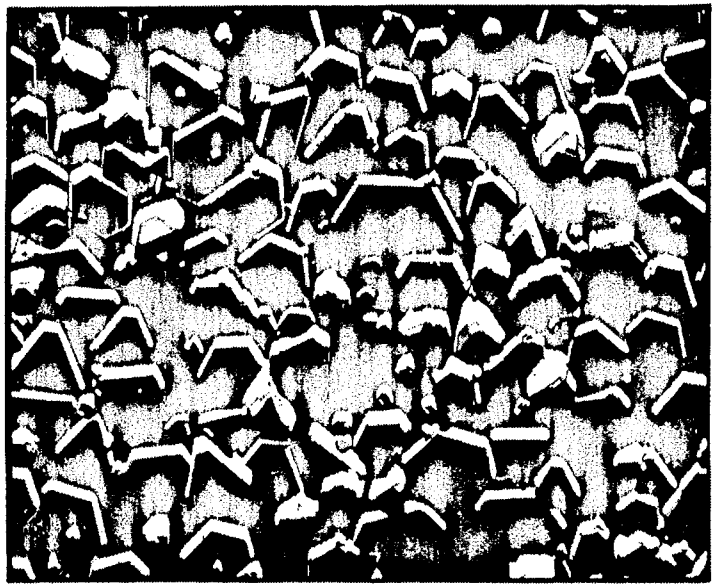

In the present invention, a junctioned grain having substantially one junction (hereinafter called one-point junctioned grain hereinafter) is defined as a grain having only one epitaxially grown portion junctioned to a substrate grain as is shown in FIG. 1A. Also, a grain, in which a total volume of at least one small grown portion ($V_2$) is less than 20% of a volume of main grown portions ($V_1$) as is shown in FIGS. 1B and 1C, is regarded as one-point junctioned grain.

The present inventors have found that a silver halide emulsion, in which junctioned grains having substantially one junction per grain occupy 30% or more, preferably, 50% or more, and more preferably, 70% or more of a total projected area of all grains, can be prepared by adding a spectral sensitizing dye or an adsorptive photographic additive, as a site director, in an amount of 100% or more of the saturated adsorption quantity of silver halide crystals used as substrate grains, and then adding soluble silver salt and soluble halide or fine silver halide grains to perform physical ripening and epitaxial growth of silver halide.

The "saturated adsorption quantity" means the quantity of adsorbed sensitizing dye which occupies area equal the entire surface of a grain.

At this time, an amount of the spectral sensitizing dye or adsorptive additive to be added is essentially 100% or more, preferably, 150% or more, and more preferably, 180% or more of the saturated adsorption quantity.

It is preferable for the substrate grain to contain 1 to 15 mol % of silver iodide. Especially when the amount of the dye or the like added is less than 150% of the saturated adsorption quantity, the substrate grain preferably contains 3 mol % or more of iodide.

The dye usable in the present invention includes a polymethine dye containing cyanine, merocyanine, complex cyanine and complex merocyanine (i.e., tri-, tetra-, and poly-nuclear-cyanine and merocyanine), oxol, hemioxonol, styryl, merostyryl, and streptocyanine.

The cyanine spectral sensitizing dye includes a compound having two basic heterocyclic nuclei bonded by a methine bond and derived from quinolinium, viridinium, isoquinolinium, 3H-indolium, benz[e]indolium , oxazolium, oxazolinium, thiazolium, thiazolinium, selenazolium, selenazolinium, imidazolium, imdazolinium, benzoxazolinium, benzothiazolium, benzoselenazolium, benzimidazolium, naphthoxazolium, naphtothiazolium, naphtoselenazdium, thiazolinium, dihydronaphthothiazolium, sodium and a quanternary imidazopyrazinium salt.

The merocyanine spectral sensitizing dye includes a dye in which, a cyanine dye type basic heterocyclic nucleus is bonded by a methine bond to an acidic nucleus derived from barbituric acid, 2-thiobarbituric acid, rhodanine, hydantoin, 2-thiohydantoin, 4-thiohydantoin, 2-pyrazoline-5-one, 2-isoxazoline-5-one, indane-1,3-dione, cyclohexane-1,3-dione, 1,3-dioxane-4,6-dione, pyrazoline-3,5-dione, pentane-2,4-dione, alkylsulfonylacetonitrile, malononitrile, isoquinoline-4-one and chroman-2,4-dione. In the present invention, various hypersensitization techniques can be used in spectral sensitization. Examples of an effective dye combination including a hypersensitizing-dye combination are described in U.S. Pat. Nos. 3,506,443 and 3,672,898. Examples of a compound usable in a spectral sensitization process to achieve a hypersensitizing-dye combination consisting of a spectral sensitizing dye and a non-light-absorptive additive are thiocyanate disclosed in U.S. Pat. No. 2,221,805, bis-triazinylaminostilbene disclosed in U.S. Pat. No. 2,933,390, a sulfonated aromatic compound disclosed in U.S. Pat. No. 2,937,089, a mercapto-substituted heterocyclic compound disclosed in U.S. Pat. No. 3,457,078, and an iodide disclosed in British Patent 1,413,826.

Various conventional methods can be used as a method of adding a sensitizing dye to the photographic emulsion. For example, as disclosed in U.S. Pat. No. 3,469,987, a sensitizing dye is dissolved in a volatile organic solvent, the resultant solution is dispersed in a hydrophilic colloid, and the colloid is added in the emulsion. In addition, the sensitizing dyes of the present invention each can be dissolved in the same or different solvents, and the solutions can be mixed before they are added in the emulsion or can be independently added therein.

A preferable example of a dye solvent used to add the sensitizing dye in the silver halide emulsion is a water-miscible organic solvent such as methyl alcohol, ethyl alcohol or acetone.

The sensitizing dye can be used in combination with another sensitizing dye or super sensitizer.

As the site director, adsorptive photographic additives such as a nitrogen-containing heterocyclic compound can be used in addition to the above dyes. An example of a formula of the nitrogen-containing heterocyclic compound is disclosed in JP-A-81-205524. These additives can be used in combination with a dye. Also, in order to form the one-point junctioned grain of the present invention, it is necessary to add 100% or more, and preferably, 150% or more of the saturated adsorption quantity of the dye or additive.

In the present invention, the binder means a hydrophilic colloid such as gelatin usually used as a protective colloid in formation of fine silver halide crystals. In addition to gelatin, a synthetic polymer compound such as polyvinyl alcohol, polyvinyl pyrrolidone and polyvinyl imidazol can be used as long as it can serve as a protective colloid.

The silver halide grains used as a substrate can be fine grains having a grain size of 0.1 μm or less or large grains having a projected area diameter of 10 μm. In addition, the silver halide emulsion can be a mono-disperse emulsion having a narrow grain size distribution or a multi-disperse emulsion.

Preferable examples of the substrate grain for forming the junctioned grain is a grain having high internal sensitivity after ripening because it has a structure inside a grain, e.g., a double-structured grain, multi-structured grain and a twinned crystal grain. These types of examples of substrate grains are preferred because a one-point junction effect is improved since a junction provides an electron concentration site. However, any of cubic, octahedral and tetradecahedral grains and other polyhedral grains having crystal planes of higher order of regular crystals can be used. In addition, a mixture of grains of various crystal shapes can be used. The halide composition can be any silver halide such as silver bromide, silver iodobromide, silver chloride, silver chlorobromide and silver chloroiodobromide as long as the crystal has a rock-salt structure. Preferable examples are silver bromide and silver iodobromide. More preferably, the iodide amount is 5% or more to less than 40% of the total halide content. The halide composition of an epitaxially grown portion can be, similar to a host, any silver halide such as silver bromide, silver chloride, silver iodide and a mixed crystal consisting of a combination thereof. Preferably, a silver halide composition of the epitaxially grown portion has a rock-salt structure and a shorter wavelength region with regard to its absorption spectrum than that of the substrate portion.

The silver amount in an epitaxially grown portion of a junctioned grain is preferably 0.5 to 50 mol %, more preferably, 30 mol % or less, and most preferably, 10 mol % or less of the silver halide amount of the substrate.

The silver ion concentration in growing an epitaxially grown portion is not limited. When the major faces of the substrate grain are formed of (111) crystal planes, however, the junctions tend to be formed, in faces or on the edges of the substrate grains if the pAg is 7.60 or less. Therefore, such a small pAg value is not preferable in order to form one junction per grain. In this case, epitaxial growth is preferably performed at a pAg of 8.0 or more.

In the present invention, features of the emulsion can be further improved upon chemical sensitization. Chemical sensitization can be performed either before or after addition of a site director, and before and after or during epitaxial growth. Depending on the timing of chemical sensitization, however, not only a surface sensitive type emulsion but also an internally sensitive emulsion can be prepared.

Even when the spectral sensitizer and the site director are same, the spectral sensitizer can be added after a washing step.

As disclosed in JP-A-55-161229, the junctioned grain of the present invention can have an electron capture property and the like at an epitaxially grown portion by adding a water-soluble salt of metal such as Ir, Pb or Cd in epitaxial growth in formation of a junction.

The silver halide grains used as substrate grains in this invention can be prepared using the methods described in, for example, P. Glafkides, *Chimie et Physique Photographique Paul Montel*, published by Paul Montel, 1967; G. F. Duffin, *Photographic Emulsion Chemistry*, published by Focal Press, 1966; V. L. Zelikman et al, *Making and Coating Photographic Emulsion*, published by Focal Press, 1964. That is, the photographic emulsion can be prepared by, for example, an acid method, a neutralization method, and an ammonia method. Also, as a system for reacting a soluble silver salt and a soluble halide, a single jet method, a double jet method, or a combination thereof can be used. Also, a so-called back mixing method for forming silver halide grains in the existence of excessive silver ions can be used. As one system of the double jet method, a so-called controlled double jet method wherein the pAg in the liquid phase of forming a silver halide is kept at a constant value can be used. According to this method, a silver halide emulsion having a regular crystal form and almost uniform grain sizes is obtained.

Two or more kinds of silver halide emulsions separately prepared can be used as a mixture thereof.

The silver halide emulsion containing the above-described regular silver halide grains can be obtained by controlling the pAg and pH during the formation of the silver halide grains. More practically, such a method is described in *Photographic Science and Engineering*, Vol. 6, 159–165 (1962); *Journal of Photographic Science*, Vol. 12, 242–251 (1964); U.S. Pat. No. 3,655,394, and British Patent 1,413,748.

A tabular grain having an aspect ratio of 5 or more can also be used in the present invention. The tabular grain can be easily prepared by methods described in, for example, Cleve, *Photography Theory and Practice*, (1930), P. 131; Gutoff, *Photographic Science and Engineering*, Vol. 14, PP. 248 to 257, (1970); and U.S. Pat. Nos. 4,434,226, 4,414,310, 4,433,048 and 4,439,520 and British Patent 2,112,157. When the tabular grain is used, the covering power and the color sensitizing efficiency of a sensitizing dye can be advantageously improved as described in detail in U.S. Pat. No. 4,434,226.

A solvent for silver halide can be effectively used to promote ripening. For example, in a known conventional method, an excessive amount of halide ions are supplied in a reaction vessel in order to promote ripening. Therefore, it is apparent that ripening can be promoted by only supplying a halide solution into a reaction vessel. In addition, another ripening agent can be used. In this case, the total amount of these ripening agents can be mixed in a dispersion medium in the reaction vessel before a silver salt and a halide are added therein, or they can be added in the reaction vessel together with one or more halide, a silver salt or a deflocculant. Alternatively, the ripening agents can be independently added during addition of a halide and a silver salt.

Examples of the ripening agent other than the halide ion are ammonium, an amine compound and a thiocyanate such as an alkali metal thiocyanate, especially sodium or potassium thiocyanate and ammonium thiocyanate. As described in JP-B-58-1410 and Moisar et al., *Journal of Photographic Science*, Vol. 25, 1977, PP. 19 to 27, grains of the silver halide emulsion can be subjected to internal reduction sensitization in a precipitation process.

Chemical sensitization can be performed by using active gelatin as described in T. H. James, *The Theory of the Photographic Process*, 4th ed., Macmillan, 1977, PP. 67 to 76. Alternatively, chemical sensitization can be performed at a pAg of 5 to 10, a pH of 5 to 8 and a temperature of 30° to 80° C. by using sulfur, selenium, tellurium, gold, platinum, palladium and irridium, or a combination of a plurality of these sensitizers as described in Research Disclosure Vol. 120, No. 12,008 (April, 1974), Research Disclosure Vol. 34, No. 13,452 (June, 1975), U.S. Pat. Nos. 2,642,361, 3,297,446, 3,772,031, 3,857,711, 3,901,714, 4,266,018, and 3,904,415, and British Patent No. 1,315,755. A preferable chemical sensitization is gold plus sulfur sensitization. Chemically sensitization is optionally performed in the presence of gold and thiocyanate compounds or in the presence of a sulfur-containing compound described in U.S. Pat. Nos. 3,857,711, 4,266,018 and 4,054,457 or a sulfur-containing compound such as a hypo, a thiourea compound and a rhodanine compound. Chemical sensitization can also be performed in the presence of a chemical sensitization modifier. An example of the chemical sensitization modifier is a compound known to suppress fogging and increase sensitivity in the chemical sensitization process such as azaindene, azapyridazine and azapyrimidine. Examples of a chemical sensitization modifier are described in U.S. Pat. Nos. 2,131,038, 3,411,914, 3,554,757, JP-A-58-1265 and G. F. Duffin, *Photographic Emulsion Chemistry*, PP. 138 to 143. In addition to or in place of chemical sensitization, reduction sensitization can be performed by using hydrogen as described in U.S. Pat. Nos. 3,891,446 and 3,984,249. Alternatively, reduction sensitization can be performed by using stannous chloride, thiourea dioxide and polyamine or a like reducing agent as described in U.S. Pat. Nos. 2,518,698, 2,743,182 and 2,743,183, or by low-pAg (e.g., less than 5) and/or high-pH, (e.g., more than 8) processing. In addition, the spectral sensitization property can be improved by a chemical sensitization method described in U.S. Pat. Nos. 3,917,485 and 3,966,476.

In particular, a chemical sensitization method described in JP-A-61-93447 is effective when it is combined with the emulsion of the present invention.

Although the light-sensitive material of the present invention contains the above various additives, it can contain other various additives in accordance with its applications.

These additives are described in detail in *Research Disclosure*, Item 17643 (December, 1978) and Item 18716 (November, 1979) as listed in the following Table.

| Additives | RD No. 17643 | RD No. 18716 |
|---|---|---|
| 1. Chemical sensitizers | page 23 | page 648, right column |
| 2. Sensitivity increasing agents | page 23 | page 648, right column |

-continued

| Additives | RD No. 17643 | RD No. 18716 |
|---|---|---|
| 3. Spectral sensitizers, super sensitizers | pages 23–24 | page 638, right column to page 659, right column |
| 4. Brighteners | page 24 | |
| 5. Antifoggants and stabilizers | pages 24–25 | page 649, right column |
| 6. Light absorbent, filter dye, ultraviolet absorbents | pages 25–26 | page 649, right column to page 650, left column |
| 7. Stain preventing agents | page 25, right column | page 650, left to right columns |
| 8. Dye image stabilizers | page 25 | |
| 9. Hardening agents | page 26 | page 651, left column |
| 10. Binder | page 26 | page 651, left column |
| 11. Plasticizers, lubricants | page 27 | |
| 12. Coating aids, surface active agents | pages 26–27 | page 650, right column |
| 13. Antistatic agents | page 27 | page 650, right column |

A color developer used in developing the light-sensitive material of the present invention is an aqueous alkaline solution containing as a primary component, preferably, an aromatic primary amine-based color developing agent. As the color developing agent, although an aminophenol-based compound is effective, a p-phenylenediamine-based compound is preferably used. Typical examples of the p-phenylenediamine-based compound are 3-methyl-4-amino-N,N-diethylaniline, 3-methyl-4-amino-N-ethyl-N-β-hydroxyethylaniline, 3-methyl-4-amino-N-ethyl-N-β-methanesulfonamidoethylan-iline, 3-methyl-4-amino-N-ethyl-N-β-methoxyethylaniine, and sulfates, hydrochlorides and p-toluenesulfonates thereof. These compounds can be used in a combination of two or more thereof in accordance with the desired application.

In general, the color developer contains a pH buffering agent such as a carbonate, a borate or a phosphate of an alkali metal, and a development restrainer or antifoggant such as a bromide, an iodide, benzimidazoles, benzothiazoles or a mercapto compound. If necessary, the color developer can also contain a preservative such as hydroxylamine, diethylhydroxylamine, a hydrazine sulfite, a phenylsemicarbazide, triethanolamine, a catechol sulfonic acid or a triethylenediamine(1,4-diazabicyclo[2,2,2]octane); an organic solvent such as ethyleneglycol or diethyleneglycol; a development accelerator such as benzylalcohol, polyethyleneglycol, a quaternary ammonium salt or an amine; a dye forming coupler; competing coupler; a fogging agent such as sodium boron hydride; an auxiliary developing agent such as 1-phenyl-3-pyrazolidone; a viscosity imparting agent; and a chelating agent such as an aminopolycarboxylic acid, an aminopolyphosphonic acid, an alkylphosphonic acid or a phosphonocarboxylic acid. Examples of the chelating agent are ethylenediaminetetraacetic acid, nitrilotriacetic acid, diethylenetriaminepentaacetic acid, cyclohexanediaminetetraacetic acid, hydroxyethyliminodiacetic acid, 1-hydroxyethylidene-1,1-diphosphonic acid, nitrilo-N,N,N-trimethylenephosphonic acid, ethylenediamine-N,N,N'N'-tetramethylenephosphonic acid and ethylenediamine-di(o-hydroxyphenylacetic acid), and salts thereof.

In order to perform a reversal process, black-and-white development is performed and then color development is performed. As a black-and-white developer, known black-and-white developing agents, e.g., dihydroxybenzenes such as hydroquinone, 3-pyrazolidones such as 1-phenyl-3-pyrazolidone, and aminophenols such as N-methyl-p-aminophenol can be used singly or in a combination of two or more thereof.

The pH of the color developer and the black-and-white developer is generally 9 to 12. Although a replenishment amount of the developer depends on the color photographic light-sensitive material to be processed, it is generally 3 liters or less per $m^2$ of the light-sensitive material. The replenishment amount, can be decreased to 500 ml or less by decreasing the bromide ion concentration in the replenishing solution. In order to decrease the replenishment amount, the contact area of a processing tank with air is preferably decreased to prevent evaporation and oxidation of the solution upon contact with air. The replenishment amount can be decreased by using a means capable of preventing an accumulation amount of bromide ions in the developer.

The color development time is normally between 2 to 5 minutes. The processing time, however, can be shortened by setting a high temperature and a high pH and using the color developing agent at a high concentration.

The photographic emulsion layer is generally subjected to bleaching after color development. The bleaching can be performed either simultaneously with fixing (bleach fixing) or independently thereof. In addition, in order to increase the processing speed, bleach-fixing can be performed after bleaching. Also, processing can be performed in a bleach-fixing bath having two continuous tanks, fixing can be performed before bleach-fixing, or bleaching can be performed after bleach-fixing, in accordance with the desired application. Examples of the bleaching agent are a compound of a multivalent metal such as iron (III), cobalt (III), chromium (VI) and copper (II); peroxides; quinones; a nitro compound and the like. Typical examples of the bleaching agent are a ferricyanide; a dichromate; an organic complex salt of iron (III) or cobalt (III), e.g., a complex salt of an aminopolycarboxylic acid such as ethylenediaminetetraacetic acid, diethylenetriaminepentaacetic acid, cyclohexanediaminetetraacetic acid, methyliminodiacetic acid, and 1,3-diaminopropanetetraacetic acid, and glycoletherdiaminetetraacetic acid, or a complex salt of citric acid, tartaric acid or malic acid; a persulfate; a bromate; a permanganate; and a nitrobenzene. Of these compounds, an iron (III) complex salt of aminopolycarboxylic acid such as an iron (III) complex salt of ethylenediaminetetraacetic acid, and a persulfate are preferred because they can increase the processing speed and prevent environmental pollution. The iron (III) complex salt of aminopolycarboxylic acid is effective in both the bleaching solution and the bleach-fixing solution. The pH of the bleaching or the bleach-fixing solution using the iron (III) complex salt of aminopolycarboxylic acid is normally 5.5 to 8. In order to increase the processing speed, however, processing can be performed at a lower pH.

A bleaching accelerator can be used in the bleaching solution, the bleach-fixing solution and their pre-bath if necessary. Examples of an effective bleaching accelerator are described in the following patent specifications: compounds having a mercapto group or a disulfide group as described in U.S. Pat. No. 3,893,858, West German Patent Nos. 1,290,812 and 2,059,988, JP-A-53-

32736, JP-A-53-57831, JP-A-53-37418, JP-A-53-72623, JP-A-53-95630, JP-A-53-95631, JP-A-53-104232, JP-A-53-124424, JP-A-53-141623 and JP-A-53-28426, and Research Disclosure No. 17,129 (July, 1978); thiazolidine derivatives as described in JP-A-50-140129; thiourea derivatives as described in JP-B-45-8506 ("JP-B-" means examined Japanese patent application), JP-A-52-20832 and JP-A-53-32735, and U.S. Pat. No. 3,706,561; iodides as described in West German Patent No. 1,127,725 and JP-A-58-16235; polyoxyethylene compounds as described in West German Patent Nos. 966,410 and 2,748,430; a polyamine compound as described in JP-B-45-8836; compounds as described in JP-A-49-42434, JP-A-49-59644, JP-A-53-94927, JP-A-54-35727, JP-A 55-26506 and JP-A-58-163940; and a bromide ion. Of the above compounds, a compound having a mercapto group or a disulfide group is preferable because it has a good accelerating effect. In particular, the compounds described in U.S. Pat. No. 3,893,858, West German Patent No. 1,290,812, and JP-A-53-95630 are preferable. The compound described in U.S. Pat. No. 4,552,834 is also preferable. These bleaching accelerators can be added in the light-sensitive material. These bleaching accelerators are effective especially in bleach-fixing of a color light-sensitive material for photography.

Examples of the fixing agent are a thiosulfate, a thiocyanate, a thioether-based compound, a thiourea and a large amount of an iodide. Of these compounds, a thiosulfate, especially, ammonium thiosulfate can be used in a widest range of applications. As the preservative of the bleach-fixing solution, a sulfite, a bisulfite or a carbonyl bisulfite adduct is preferred.

The photographic light-sensitive material of the present invention is normally subjected to washing and/or stabilizing steps, after desilvering. An amount of water used in the washing step can be arbitrarily determined over a broad range in accordance with the properties of the light-sensitive material (e.g., a property determined by the components used in the material such as coupler), the application of the material, the temperature of the washing water, the number of washing water tanks (the number of stages), a replenishing scheme representing e.g. a counter or forward current, and other conditions. The relationship between the amount of water and the number of washing tanks in a multi-stage counter-current scheme can be obtained by a method described in "Journal of the Society of Motion Picture and Television Engineers", No. 64, PP. 248–253 (May, 1955).

According to the above-described multi-stage counter-current scheme, the amount of water used for washing can be greatly decreased. Since washing water stays in the tanks for a long period of time, however, bacteria multiply and floating substances can be undesirably attached to the light-sensitive material. In order to solve this problem during the processing of the color photographic light-sensitive material of the present invention, a method of decreasing calcium and magnesium ions can be effectively utilized, as described in JP-A-62-288838 and Japanese Patent Application No. 61-131,632. In addition, other materials may be used including a germicide such as an isothiazolone compound and cyabendazoles described in JP-A-57-8542, a chlorine-based germicide such as sodium chlorinated isocyanurate, and germicides such as benzotriazole described in Hiroshi Horiguchi, "Chemistry of Antibacterial and Antifungal Agents", Eiseigijutsu-Kai ed., "Sterilization, Antibacterial, and Antifungal Techniques for Microorganisms", and Nippon Bokin Bokabi Gakkai ed., "Dictionary of Antibacterial and Antifungal Agents".

The pH of the water for washing the photographic light-sensitive material of the present invention is 4 to 9, and preferably, 5 to 8. The water temperature and the washing time can vary in accordance with the properties and applications of the light-sensitive material. Normally, the washing time is 20 seconds to 10 minutes at a temperature of 15° to 45° C., and preferably, 30 seconds to 5 minutes at 25° to 40° C. The light-sensitive material of the present invention can be processed directly by a stabilizing solution in place of washing. All known methods described in JP-A-57-8543, JP-A-58-14834 and JP-A-60-220345 can be used in such stabilizing processing.

Stabilizing is sometimes performed subsequently to washing. An example is a stabilizing bath which contains formalin and a surface-active agent and is used as a final bath of the photographic color light-sensitive material. Various chelating agents or antifungal agents can be added in the stabilizing bath.

An overflow solution produced upon replenishment of the washing solution and/or stabilizing solution can be reused in another step such as a desilvering step.

The silver halide color light-sensitive material of the present invention can contain a color developing agent in order to simplify processing and increase a processing speed. For this purpose, it is preferred to use various precursors of the color developing agent. Examples are an indoaniline-based compound described in U.S. Pat. No. 3,342,597; Schiff base compounds described in U.S. Pat. No. 3,342,599 and Research Disclosure Nos. 14,850 and 15,159; an aldol compound described in Research Disclosure No. 13,924; a metal complex salt described in U.S. Pat. No. 3,719,492; and a urethane-based compound described in JP-A-53-135628.

The silver halide color light-sensitive material of the present invention can contain various 1-phenyl-3-pyrazolidones in order to accelerate color development, if necessary. Typical examples of the compound are described in JP-A-56-64339, JP-A-57-144547 and JP-A-58-115438.

Each processing solution in the present invention can be used at a temperature of 10° to 50° C. Although a normal processing temperature is 33° to 38° C., processing can be accelerated at a higher temperature to shorten the processing time, or image quality or stability of a processing solution can be improved at a lower temperature. In order to save silver for the light-sensitive material, processing using cobalt intensification or hydrogen peroxide intensification described in West German Patent No. 2,226,770 or U.S. Pat. No. 3,674,499 may be performed.

EXAMPLES

The present invention will be described in detail below by way of the following examples.

EXAMPLE 1

As a substrate emulsion, use was made of an emulsion containing, per kilogram, 0.8 mol of dispersed double-structured twinning silver iodobromide grains. These grains have an average sphere-equivalent diameter of 1.6 μm, a core/shell ratio of 1:2 and an average iodide content of 10 mol %.

It was confirmed that the silver halide crystal in this emulsion had a rock-salt structure by X-ray diffraction and the like.

1,000 cc of water were added to 850 g of the emulsion. The resultant emulsion was heated to 45° C. and dissolved. A panchromatic spectral sensitizing dye shown below was added to the emulsion.

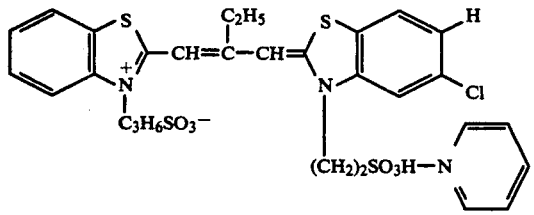

The content of the dye was set at the following three levels with respect to a saturated absorption quantity.

| | |
|---|---|
| 1 | 0% |
| 2 | 60% |
| 3 | 200% |

After the dye was added, halogen and silver were added in the following combinations at a constant rate, thereby preparing junctioned grains.

| | | |
|---|---|---|
| A | $AgNO_3$ | 6.0 g |
| | NaCl | 2.1 g |
| B | $AgNO_3$ | 6.0 g |
| | NaCl | 1.1 g |
| | KBr | 2.1 g |
| C | $AgNO_3$ | 6.0 g |
| | KBr | 4.2 g |
| D | No addition | |

After epitaxial growth, the emulsion was processed by normal desilvering and dispersing steps. The prepared grains were formed into samples by a replica method and then observed by a transmitting electron microscope, thereby observing the epitaxial growth. Table 1 shows a ratio of projected area of grains, having substantially only one junction in each emulsion.

A distribution of the numbers of junctions per grain of an emulsion 3-A which is a typical example of the present invention is shown in Table 2. Electron micrographs of emulsions 3-A, 3-B and 3-C of the present invention, an emulsion 2-A of a comparative example and a substrate grain are shown in FIGS. 2A to 2E. Grains in comparative emulsion 2-A have a plurality of junctions. It is apparent that a projected area of the one-point junctioned grains of the present invention is 30% or more of that of all the grains.

TABLE 1

| Emulsion No. | Dye Amount | Halide Composition of Junctioned Portion | Ratio of Projected Area of One-Point Junctioned Grain | |
|---|---|---|---|---|
| 1 - A | 0% | AgCl | 0% | Comparative Example |

TABLE 1-continued

| Emulsion No. | Dye Amount | Halide Composition of Junctioned Portion | Ratio of Projected Area of One-Point Junctioned Grain | |
|---|---|---|---|---|
| 1 - B | " | AgClBr | 0% | Comparative Example |
| 1 - C | " | AgBr | 0% | Comparative Example |
| 1 - D | " | — | 0% | Comparative Example |
| 2 - A | 60% | AgCl | 0~3% | Comparative Example |
| 2 - B | " | AgClBr | 0~3% | Comparative Example |
| 2 - C | " | AgBr | 0~3% | Comparative Example |
| 2 - D | " | — | 0% | Comparative Example |
| 3 - A | 200% | AgCl | 76% | Present Invention |
| 3 - B | " | AgClBr | 70% | Present Invention |
| 3 - C | " | AgBr | 71% | Present Invention |
| 3 - D | " | — | 0% | Comparative Example |

TABLE 2

| Distribution of Number of Junctions per Grain in Emulsion 3-A (Number of Samples = 284) | |
|---|---|
| Number of Junctions per Grain | Ratio (%) |
| 0 | 8.8 |
| 1 | 75.7 |
| 2 | 13.7 |
| 3 | 1.8 |
| 4 | 0 |

EXAMPLE 2

Of the emulsions prepared in Example 1, the following emulsions were chemically ripened using sodium thiosulfate so as to obtain optimal characteristics for 1/100'-exposure.

TABLE 3

| Emulsion No. | Dye Amount | Halide Composition of Junctioned Portion | Ratio of Projected Area of One-Point Junctioned Grain | |
|---|---|---|---|---|
| 1 - D | — | — | 0% | Comparative Example |
| 2 - A | 60% | AgCl | 0~3% | Comparative Example |
| 3 - A | 200% | AgCl | 76% | Present Invention |
| 3 - B | " | AgClBr | 70% | Present Invention |
| 3 - C | " | AgBr | 71% | Present Invention |
| 3 - D | " | — | 0% | Comparative Example |

Emulsion and protective layers in amounts as listed in Table 4 were coated on triacetylcellulose film supports having undercoating layers.

TABLE 4

(1) Emulsion Layer

TABLE 4-continued

| | |
|---|---|
| Emulsion . . . six types of emulsions shown in Table 3 | (silver $1.7 \times 10^{-2}$ mol/m$^2$) |
| Coupler | ($1.5 \times 10^{-3}$ mol/m$^2$) |

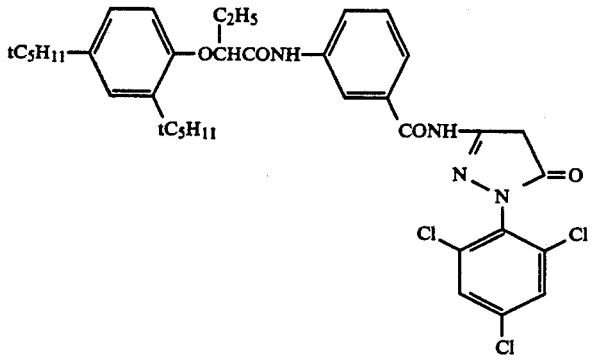

| | |
|---|---|
| Tricresylphosphate | (1.10 g/m$^2$) |
| Gelatin | (2.30 g/m$^2$) |
| (2) Protective Layer | |
| 2,4-dichlorotriazine-6-hydroxy-s-triazine sodium salt | (0.08 g/m$^2$) |
| Gelatin | (1.80 g/m$^2$) |

These samples were kept at a relative humidity of 70% for 14 hours and then subjected to sensitometry exposure, thereby performing the following color development.

The processed samples were subjected to density measurement by using a green filter. The obtained photographic performance results are listed in Table 5.

Development was performed under the following conditions at a temperature of 38° C.

| | |
|---|---|
| 1. Color Development | 2 min. 45 sec. |
| 2. Bleaching | 6 min. 30 sec. |
| 3. Washing | 3 min. 15 sec. |
| 4. Fixing | 6 min. 30 sec. |
| 5. Washing | 3 min. 15 sec. |
| 6. Stabilizing | 3 min. 15 sec. |

The compositions of processing solutions used in the above steps were as follows.

| | |
|---|---|
| Color Developer: | |
| Sodium Nitrilotriacetate | 1.0 g |
| Sodium Sulfite | 4.0 g |
| Sodium Carbonate | 30.0 g |
| Potassium Bromide | 1.4 g |
| Hydroxylamine Sulfate | 2.4 g |
| 4-(N-ethyl-N-β-hydroxyethylamino)-2-methyl-aniline Sulfate | 4.5 g |
| Water to make | 1 l |
| Bleaching Solution: | |
| Sodium Bromide | 160.0 g |
| Ammonia Solution (28%) | 25.0 ml |
| Sodium Ethylenediaminetetraacetate | 130 g |
| Glacial Acetic Acid | 14 ml |
| Water to make | 1 l |
| Fixing Solution: | |
| Sodium Tetrapolyphosphate | 2.0 g |
| Sodium Sulfite | 4.0 g |
| Ammonium Thiosulfate (700 g/l) | 175.0 ml |
| Sodium Bisulfite | 4.6 g |
| Water to make | 1 l |
| Stabilizing Solution: | |
| Formalin | 8.0 ml |
| Water to make | 1 l |

The samples were subjected to normal sensitometry wedge exposure of 1/100 second (low intensity) and 1/10000 second (high intensity) such that almost the same exposure amount was obtained. A light source was adjusted at a color temperature of 4,800° K. by using a filter, and blue light was used by using a blue filter. Sensitivities were compared at a point from a fog by an optical density of 0.2. The sensitivities are listed as relative sensitivities in Table 5 assuming that the sensitivity of a sample using the emulsion 1-D is 100. Each emulsion of the present invention has higher sensitivity, especially at high intensity, than that of an emulsion having a plurality of junctions or an emulsion to which only a dye is added. Of the samples using the emulsions 3-A, 3-B and 3-C of the present invention, the sample of the emulsion 3-A, in which a threshold value of light absorption of a silver halide of an epitaxially grown portion reaches only a shortest wavelength, has highest sensitivity.

TABLE 5

| Emulsion | 1/100 sec Sensitivity | 1/10,000 sec Sensitivity |
|---|---|---|
| 1-D | 100 | 100 |
| 2-A | 105 | 104 |
| 3-A | 120 | 126 |
| 3-B | 118 | 120 |
| 3-C | 110 | 118 |
| 3-D | 15 | 10 |

EXAMPLE 3

The emulsions of the present invention prepared in Example 1 were chemically sensitized using sodium thiosulfate and chloroauric acid to obtain optimal characteristics, coated samples were prepared following the same procedures as in Example 2, and sensitometry was performed. As a result, as in Example 2, it was confirmed that the sample coated with the emulsion of the present invention had high sensitivity, especially at high intensity.

EXAMPLE 4

Emulsions for green- and red-sensitive layers were prepared following the same procedures as for the emulsion 3-B in Example 1. The spectral sensitizing dye used in Example 1 was used for the red-sensitive layer emulsion. The following spectral sensitizing dye was used for the green-sensitive layer emulsion.

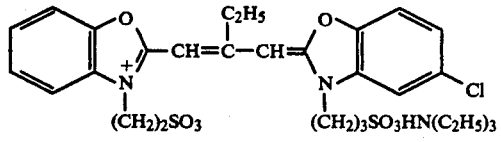

The resultant emulsions were subjected to normal gold-plus-sulfur sensitization. The prepared emulsions for the red- and green-sensitive layer were used as emulsions 4 and 5, respectively. Using these emulsions, a multilayer color light-sensitive material comprising a plurality of layers having the following compositions was formed on an undercoated triacetylcellulose film support to prepare a sample 101.

When the sample was subjected to sensitometric exposure by using a light source having a color temperature of 4,800° K. and developed following the same procedures as in Example 2, the sample showed a good photographic property.

Compositions of Light-Sensitive Layers of Sample 101

The amounts of the compounds are represented by g/m$^2$, provided that the amounts of silver halide and colloid silver are represented by g/m$^2$ of silver, and an amount of a sensitizing dye is represented by mol per mol of silver halide in the corresponding layer.

| | |
|---|---|
| Layer 1: Antihalation Layer | |
| Black Colloid Silver | 0.2 |
| coating silver amount | |
| Gelatin | 2.2 |
| UV-1 | 0.1 |
| UV-2 | 0.2 |
| Cpd-1 | 0.05 |
| Solv-1 | 0.01 |
| Solv-2 | 0.01 |
| Solv-3 | 0.08 |
| Layer 2: Interlayer | |
| Fine Silver Bromide Grain (sphere-equivalent diameter = 0.07μ) | 0.15 |
| coating silver amount | |
| Cpd-2 | 0.2 |
| Layer 3: 1st Red-Sensitive Emulsion Layer | |
| Silver Iodobromide Emulsion (AgI = 10.0 mol %, internally high AgI content type, sphere-equivalent diameter = 0.7μ, variation coefficient of sphere-equivalent diameter = 14%, tetradecahedral grain) | 0.26 |
| coating silver amount | |
| Silver Iodobromide Emulsion (AgI = 4.0 mol %, internally high AgI content type, sphere-equivalent diameter = 0.4μ, variation coefficient of sphere-equivalent diameter = 22%, tetradecahedral grain) | 0.2 |
| coating silver amount | |
| Gelatin | 1.0 |
| ExS-1 | $4.5 \times 10^{-4}$ |
| ExS-2 | $1.5 \times 10^{-4}$ |
| ExS-3 | $0.4 \times 10^{-4}$ |
| ExS-4 | $0.3 \times 10^{-4}$ |
| ExC-1 | 0.33 |
| ExC-2 | 0.009 |
| ExC-3 | 0.023 |
| ExC-6 | 0.14 |
| Layer 4: 2nd Red-Sensitive Emulsion Layer | |
| Silver Iodobromide Emulsion (AgI = 16 mol %, high AgI content type, sphere-equivalent diameter = 1.0μ, variation coefficient of sphere-equivalent diameter = 25%, tabular grain, diameter/thickness ratio = 4.0) | 0.55 |

-continued

| | |
|---|---|
| coating silver amount | |
| Gelatin | 0.7 |
| ExS-1 | $3 \times 10^{-4}$ |
| ExS-2 | $1 \times 10^{-4}$ |
| ExS-3 | $0.3 \times 10^{-4}$ |
| ExS-4 | $0.3 \times 10^{-4}$ |
| ExC-6 | 0.08 |
| ExC-3 | 0.05 |
| ExC-4 | 0.10 |
| Layer 5: 3rd Red-Sensitive Emulsion Layer | |
| Emulsion 4 of Silver Iodobromide Emulsion (AgI = 10.0 mol %, internally high AgI content type, sphere-equivalent diameter 1.2μ, variation coefficient of sphere-equivalent diameter = 28%, tabular grain, diameter/thickness ratio = 6.0) | 0.9 |
| coating silver amount | |
| Gelatin | 0.6 |
| ExS-1 | $2 \times 10^{-4}$ |
| ExS-2 | $0.6 \times 10^{-4}$ |
| ExS-3 | $0.2 \times 10^{-4}$ |
| ExC-4 | 0.07 |
| ExC-5 | 0.06 |
| Solv-1 | 0.12 |
| Solv-2 | 0.12 |
| Layer 6: Interlayer | |
| Gelatin | 1.0 |
| Cpd-4 | 0.1 |
| Layer 7: 1st Green-Sensitive Emulsion Layer | |
| Silver Iodobromide Emulsion (AgI = 10.0 mol %, internally high AgI content type, sphere-equivalent diameter = 0.7μ, variation coefficient of sphere-equivalent diameter = 14%, tetradecahedral grain) | 0.2 |
| coating silver amount | |
| Silver Iodobromide Emulsion (AgI = 4.0 mol %, internally high AgI content type, sphere-equivalent diameter = 0.4μ, variation coefficient of sphere-equivalent diameter = 22%, tetradecahedral grain) | 0.1 |
| coating silver amount | |
| Gelatin | 1.2 |
| ExS-5 | $5 \times 10^{-4}$ |
| ExS-6 | $2 \times 10^{-4}$ |
| ExS-7 | $1 \times 10^{-4}$ |
| ExM-1 | 0.41 |
| ExM-2 | 0.10 |
| ExM-5 | 0.03 |
| Solv-1 | 0.2 |
| Layer 8: 2nd Green-Sensitive Emulsion Layer | |
| Silver Iodobromide Emulsion (AgI = 10 mol %, internally high iodide content type, sphere-equivalent diameter = 1.0μ, variation coefficient of sphere-equivalent diameter = 25%, tabular grain, diameter/thickness ratio = 3.0) | 0.4 |
| coating silver amount | 0.4 |
| Gelatin | 0.35 |
| ExS-5 | $3.5 \times 10^{-4}$ |
| ExS-6 | $1.4 \times 10^{-4}$ |
| ExS-7 | $0.7 \times 10^{-4}$ |
| ExM-1 | 0.09 |
| ExM-3 | 0.01 |
| Solv-1 | 0.15 |
| Layer 9: Interlayer | |
| Gelatin | 0.5 |
| Layer 10: 3rd Green-Sensitive Emulsion Layer | |
| Emulsion 5 of Silver Iodobromide Emulsion (AgI = 10.0 mol %, internally. high AgI content type, sphere-equivalent diameter = 1.2μ, variation coefficient of sphere-equivalent diameter = 28%, tabular grain, diameter/thickness ratio = 6.0) | 1.0 |
| coating silver amount | |
| Gelatin | 0.8 |
| ExS-5 | $2 \times 10^{-4}$ |
| ExS-6 | $0.8 \times 10^{-4}$ |
| ExS-7 | $0.8 \times 10^{-4}$ |
| ExM-4 | 0.04 |
| ExM-3 | 0.01 |
| ExC-4 | 0.005 |
| Solv-1 | 0.2 |
| Layer 11: Yellow Filter Layer | |

-continued

| | |
|---|---|
| Cpd-3 | 0.05 |
| Gelatin | 0.5 |
| Solv-1 | 0.1 |
| Layer 12: Interlayer | |
| Gelatin | 0.5 |
| Cpd-2 | 0.1 |
| Layer 13: 1st Blue-Sensitive Emulsion Layer | |
| Silver Iodobromide Emulsion (AgI = 10 mol %, internally high iodide content type, sphere-equivalent diameter = 0.7μ, variation coefficient of sphere-equivalent diameter = 14%, tetradecahedral grain) coating silver amount | 0.1 |
| Silver Iodobromide Emulsion (AgI = 4.0 mol %, internally high iodide content type, sphere-equivalent diameter = 0.4μ, variation coefficient of sphere-equivalent diameter = 22%, tetradecahedral grain) coating silver amount | 0.05 |
| Gelatin | 1.0 |
| ExS-8 | $3 \times 10^{-4}$ |
| ExY-1 | 0.53 |
| ExY-2 | 0.02 |
| Solv-1 | 0.15 |
| Layer 14: 2nd Blue-Sensitive Emulsion Layer | |
| Silver Iodobromide Emulsion (AgI = 19.0 mol %, internally high AgI content type, sphere-equivalent diameter = 1.0μ, variation coefficient of sphere-equivalent diameter = 16%, tetradecahedral grain) coating silver amount | 0.19 |
| Gelatin | 0.3 |
| ExS-8 | $2 \times 10^{-4}$ |
| ExY-1 | 0.22 |
| Solv-1 | 0.07 |

-continued

| | |
|---|---|
| Layer 15: Interlayer | |
| Fine Silver Iodobromide Grain (AgI = 2 mol %, homogeneous type, sphere-equivalent diameter = 0.13μ) coating silver amount | 0.2 |
| Gelatin | 0.36 |
| Layer 16: 3rd Blue-Sensitive Emulsion Layer | |
| Silver Iodobromide Emulsion (AgI = 14.0 mol %, internally high AgI content type, sphere-equivalent diameter = 1.5μ, variation coefficient of sphere-equivalent diameter = 28%, tabular grain, diameter/thickness ratio = 5.0) coating silver amount | 1.0 |
| Gelatin | 0.5 |
| ExS-8 | $1.5 \times 10^{-4}$ |
| ExY-1 | 0.2 |
| Solv-1 | 0.07 |
| Layer 17: 1st Protective Layer | |
| Gelatin | 1.8 |
| UV-1 | 0.1 |
| UV-2 | 0.2 |
| Solv-1 | 0.01 |
| Solv-2 | 0.01 |
| Layer 18: 2nd Protective Layer | |
| Fine Silver Bromide Grain (sphere-equivalent diameter = 0.07μ) coating silver amount | 0.18 |
| Gelatin | 0.7 |
| Polymethylmethacrylate Grain (diameter = 1.5μ) | 0.2 |
| W-1 | 0.02 |
| H-1 | 0.4 |
| Cpd-5 | 1.0 |

UV-1

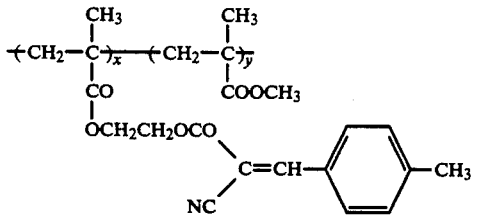

x/y = 7/3 (weight ratio)

UV-2

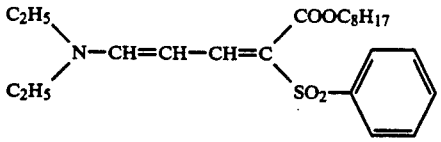

ExM-3

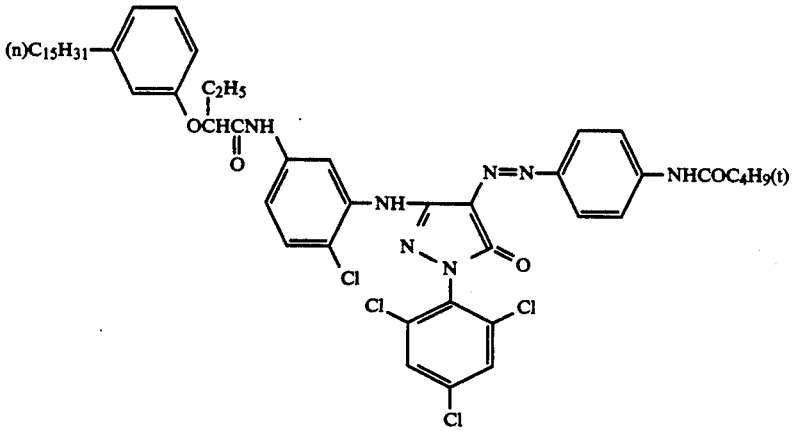

-continued
ExC-3
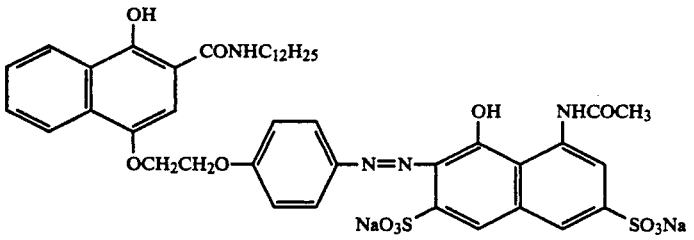
ExC-1
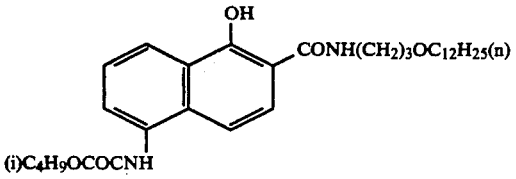
ExC-6
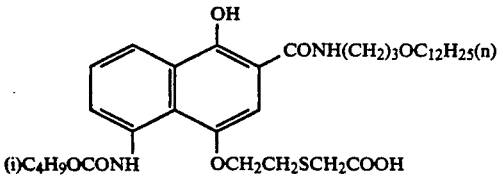
ExC-2
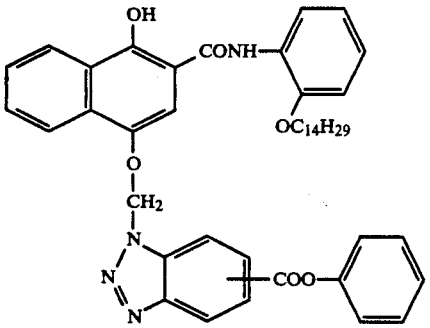
ExC-4
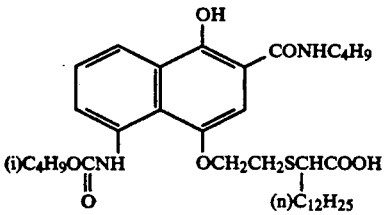
ExC-5
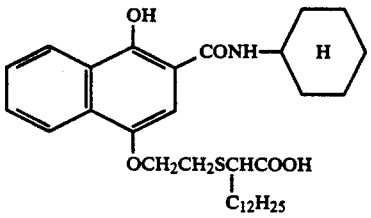

-continued
ExM-1
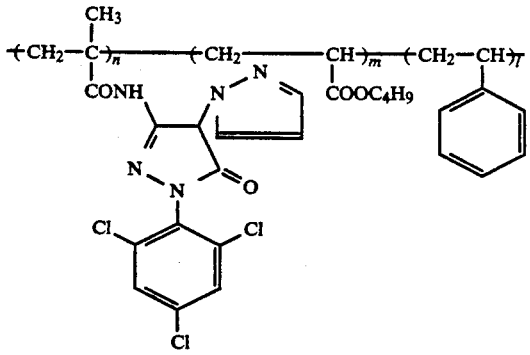
n:m:l = 2:1:1 (weight ratio)
average molecular weight 40,000
ExM-2
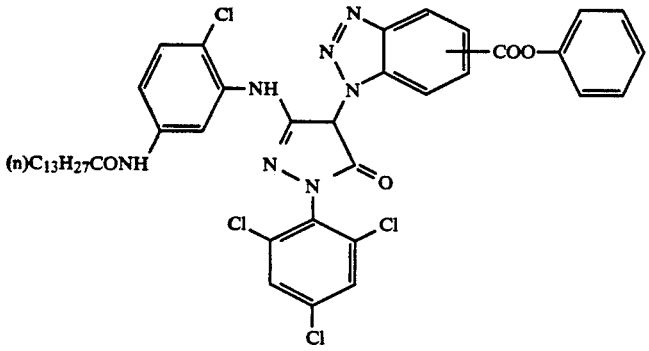
ExM-4
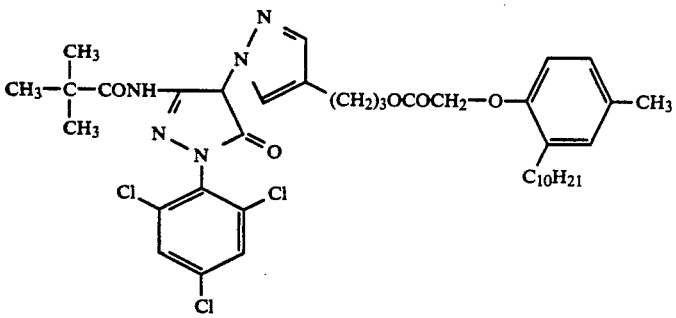
ExM-5
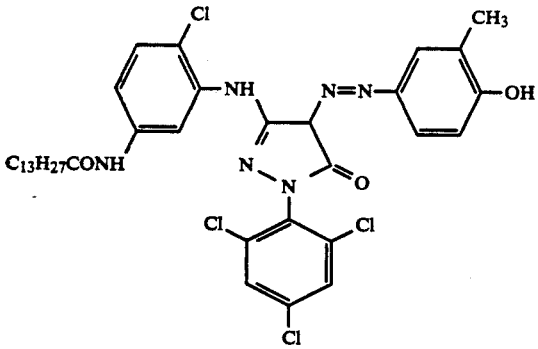
ExY-1
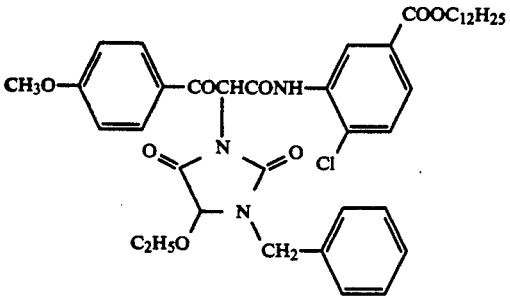

-continued
ExY-2
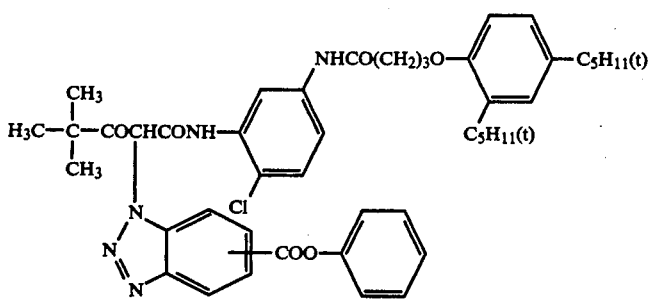
ExS-1
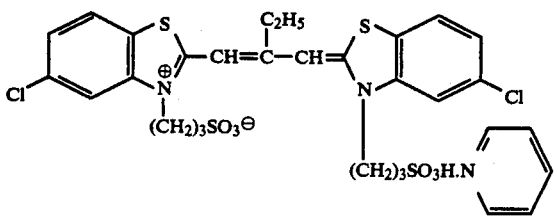
ExS-2
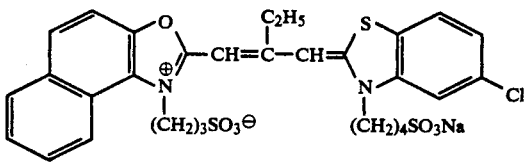
ExS-3
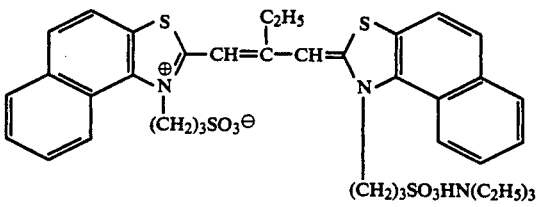
ExS-4
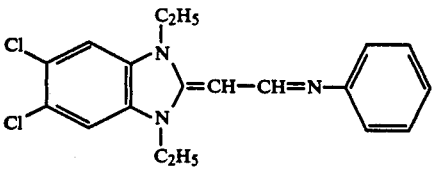
ExS-5
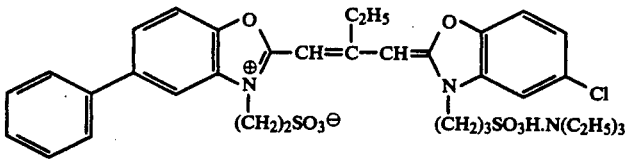
ExS-6
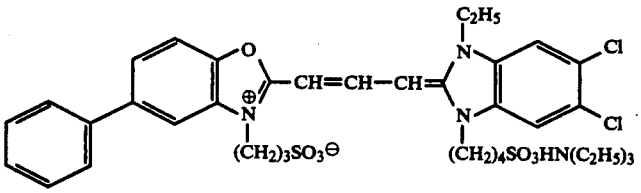
ExS-8
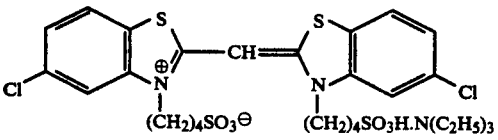

-continued
ExS-7
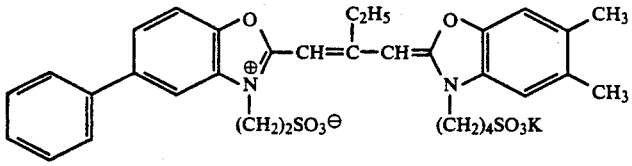
Solv-1
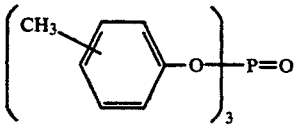
Solv-2
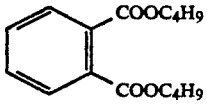
Solv-3
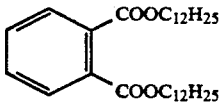
Cpd-1
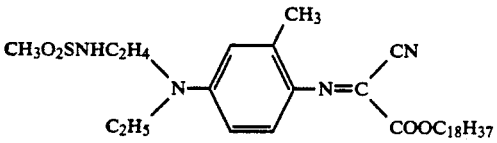
Cpd-2
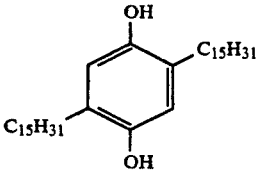
Cpd-3
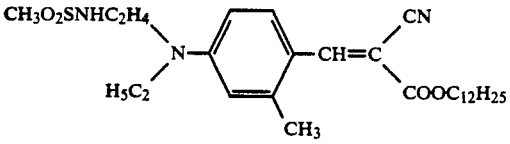
Cpd-4
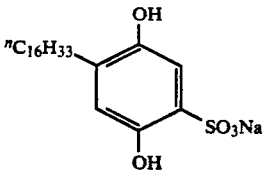
Cpd-5
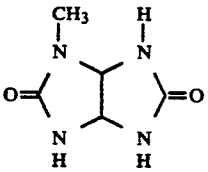
W-1
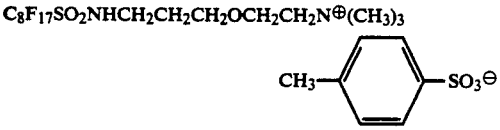
H-1
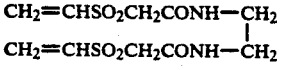
What is claimed is:

adding a spectral sensitizing dye selected from the group consisting of cyanine, merocyanine, complex cyanine, complex merocyanine, oxol, hemioxonol, styryl, merostyryl and streptocyanine, or an adsorptive photographic additive, in an amount of 150% or more of the saturated adsorption quantity of silver halide crystals used as substrate grains, and adding soluble silver salt and soluble halide or fine silver halide grains to perform physical ripening and epitaxial growth of silver halide.

2. The silver halide photographic emulsion as in claim 1, wherein said substrate grain contains 1 to 15 mol % of silver iodide.

3. The silver halide photographic emulsion as in claim 1, wherein the emulsion has been subjected to gold plus sulfur sensitization.

4. The silver halide photographic emulsion as in claim 1, wherein said junctioned grain has a portion of silver chloride, silver bromochloride, or silver bromide, epitaxially grown on said substrate grain of silver bromoiodide.

5. The silver halide emulsion of claim 1, wherein the spectral sensitizing dye or the adsorptive photographic additive are added in an amount of 180% or more of the saturated adsorption quantity of silver halide crystals used as substrate grains.

6. The silver halide emulsion of claim 1, wherein said adsorptive photographic additive is a nitrogen-containing heterocyclic compound.

* * * * *